US007255512B2

(12) United States Patent
Wallace

(10) Patent No.: US 7,255,512 B2
(45) **Date of Patent: *Aug. 14, 2007**

(54) TRENCH FILLING DEVICE

(76) Inventor: Marvin A. Wallace, P.O. Box 932, Wynne, AR (US) 72396

( * ) Notice: Subject to any disclaimer, the term of this patent is extended or adjusted under 35 U.S.C. 154(b) by 0 days.

This patent is subject to a terminal disclaimer.

(21) Appl. No.: 11/495,650

(22) Filed: Jul. 28, 2006

(65) Prior Publication Data

US 2006/0265911 A1 Nov. 30, 2006

Related U.S. Application Data

(63) Continuation of application No. 11/247,708, filed on Oct. 11, 2005, now Pat. No. 7,104,726, which is a continuation of application No. 10/780,260, filed on Feb. 17, 2004, now abandoned.

(51) Int. Cl.
*E01C 19/20* (2006.01)
*A01B 15/00* (2006.01)
*A01B 15/10* (2006.01)

(52) U.S. Cl. ..... 404/83; 404/101; 404/110; 172/684.5; 172/445.1

(58) Field of Classification Search ..... 404/83, 404/101, 110, 118; 172/684.5, 445.01, 149, 172/150, 175, 176
See application file for complete search history.

(56) References Cited

U.S. PATENT DOCUMENTS 975,457 A 11/1910 Ransome
1,112,016 A 9/1914 MacLachlan
1,384,617 A 7/1921 Lee
2,585,117 A 2/1952 Gurries
3,157,139 A 11/1964 Spindler
3,471,953 A 10/1969 Wyatt
3,680,451 A 8/1972 Birtchet
3,680,452 A 8/1972 Mangum
3,776,318 A 12/1973 Layton
3,797,582 A 3/1974 Couch
4,019,825 A 4/1977 Berrange
4,056,328 A 11/1977 Maxey
4,244,662 A * 1/1981 Olson ..... 404/118
4,339,004 A 7/1982 van der Lely et al.
4,395,156 A * 7/1983 Sprague, III ..... 404/110
4,539,765 A 9/1985 Reece
4,802,293 A * 2/1989 Smith ..... 37/381
5,114,269 A 5/1992 Shepherd
5,427,185 A * 6/1995 Seal ..... 172/684.5
5,526,590 A 6/1996 Palm et al.
5,533,283 A 7/1996 Roth
5,659,983 A 8/1997 Coutarel et al.
5,845,717 A 12/1998 Gillespie
6,139,223 A 10/2000 Snyder
6,273,637 B1 8/2001 Peterson (Continued)

FOREIGN PATENT DOCUMENTS

DE 3631543 A1 3/1988

(Continued)

*Primary Examiner*—Raymond Addie
(74) *Attorney, Agent, or Firm*—Dunlap Codding & Rogers, P.C.

(57) ABSTRACT

A device for filling an open trench with the dirt previously removed from the trench lying alongside the trench, using a skid-mounted frame having blades to initially fill the trench and leveling the dirt, followed by a compactor.

7 Claims, 7 Drawing Sheets

U.S. PATENT DOCUMENTS

| | | | |
|---|---|---|---|
| 6,338,209 | B1 | 1/2002 | McClure |
| 6,434,861 | B1 | 8/2002 | McCullough |
| 6,520,717 | B1 | 2/2003 | Otto et al. |
| 6,607,330 | B2 | 8/2003 | Philpott |

FOREIGN PATENT DOCUMENTS

| | | | |
|---|---|---|---|
| EP | 0 005 982 | A2 | 5/1979 |
| GB | 2 166 632 | A | 11/1984 |

* cited by examiner

TRENCH FILLING DEVICE

CROSS REFERENCE TO RELATED APPLICATIONS

This application is a continuation of U.S. Ser. No. 11/247,708, filed Oct. 11, 2005 now U.S. Pat. No. 7,104,726, which is a continuation of U.S. Ser. No. 10/780,260, filed Feb. 17, 2004, now abandoned, each of which are hereby incorporated by reference herein in their entireties.

FIELD OF THE INVENTION

This invention relates to a device for filling a trench with the dirt previously removed to form the trench.

DETAILED DESCRIPTION

Figure 1:
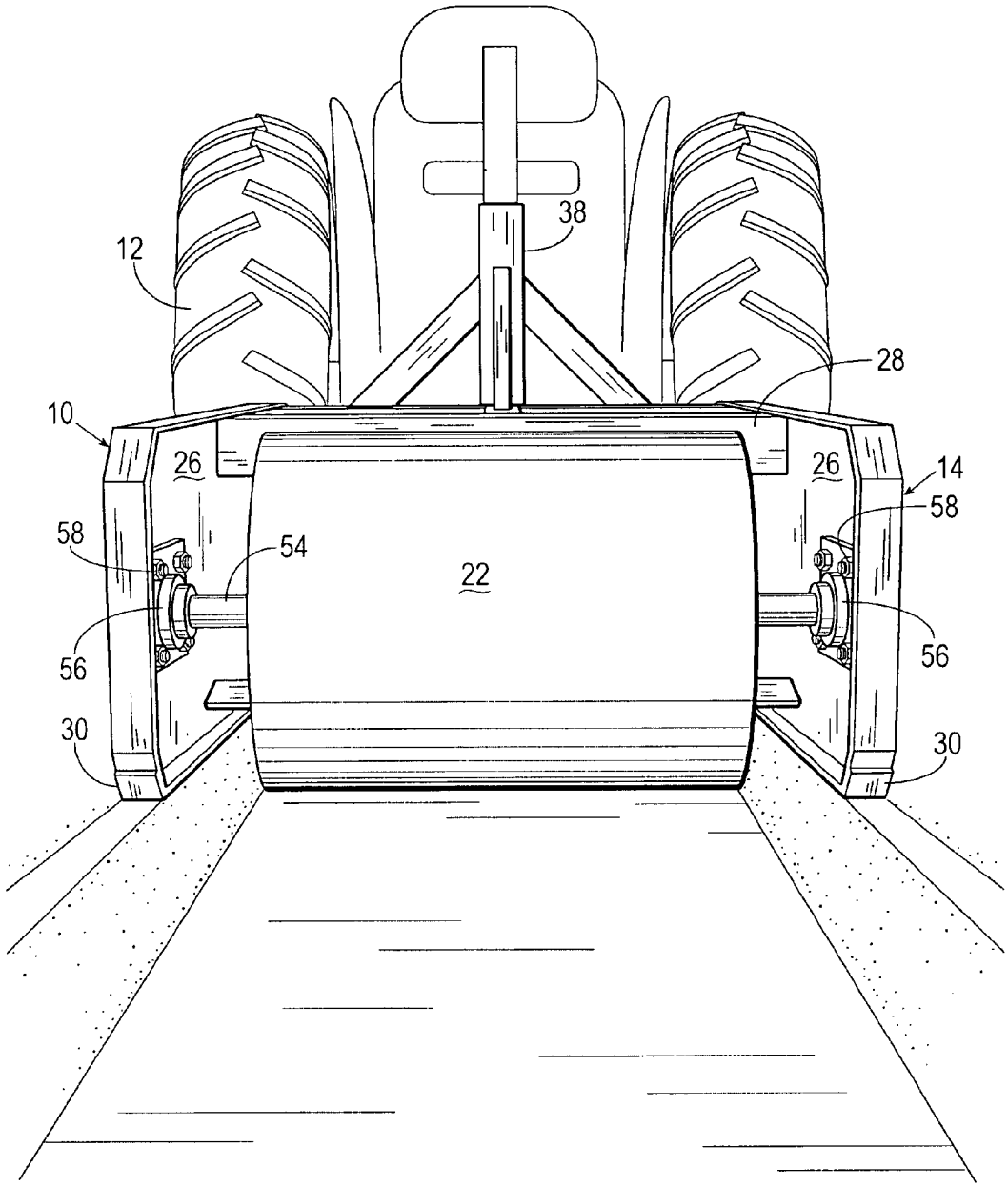
FIG. 1 is a rear-perspective view of the device attached to the rear of a pulling vehicle, such as a tractor.

Referring to the drawings in detail, and particularly to FIG. 1, reference character 10 generally designates the trench filling device of this invention which is adapted to be towed along a trench by a tractor or the like 12. In general, the device 10 comprises a frame 14 supporting a pair of rearwardly converging scraper blades 16 (FIG. 4) in the forward end 18 of the frame; a temporary leveling blade 20 (FIG. 3) rearwardly of the blades 16 and a compaction roller 22 in the rearward end 24 of the frame 14.

Figure 2:
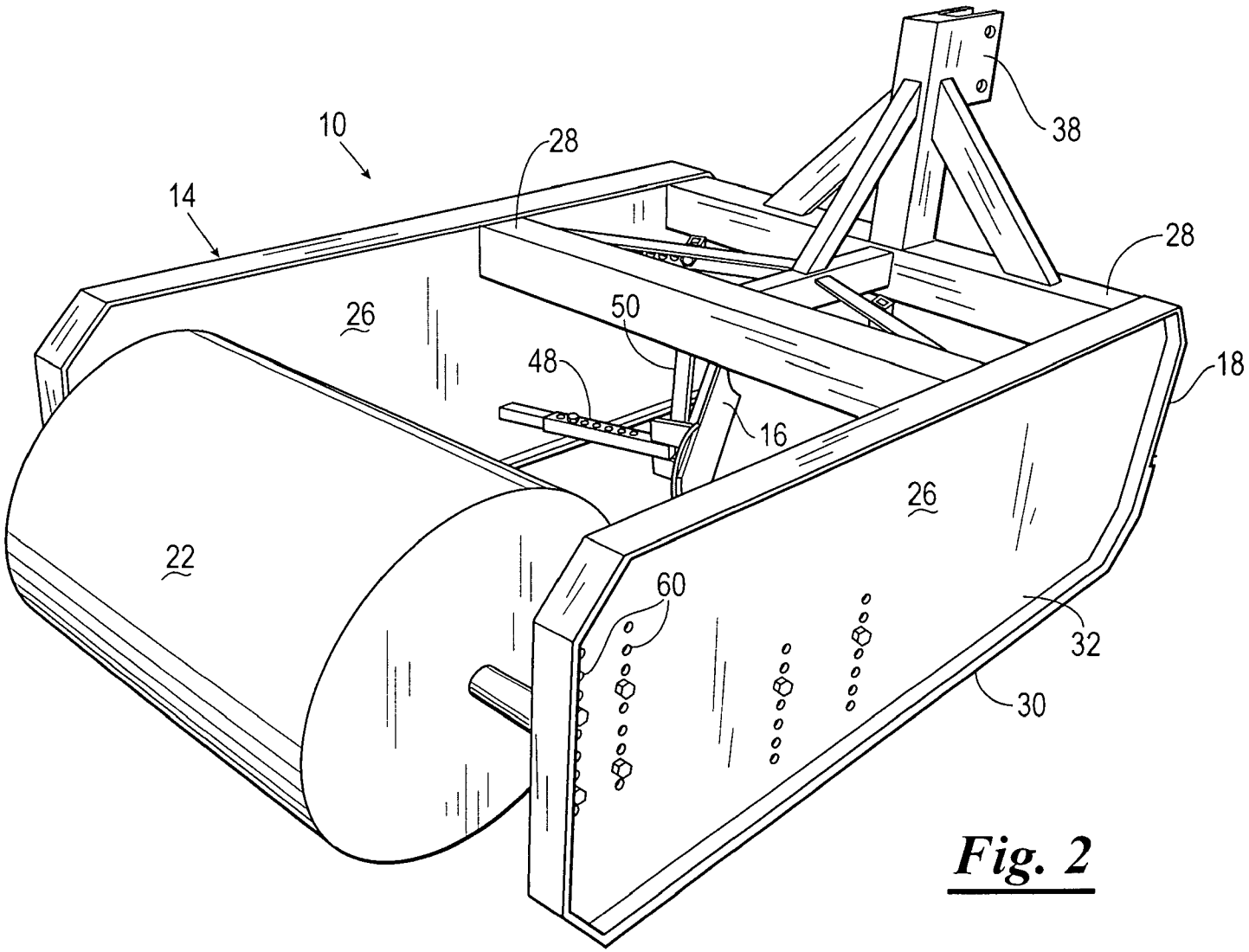
FIG. 2 is a perspective view of the device looking at the right, rear corner of the device.

As shown in FIGS. 1 and 2, the frame 14 comprises a pair of side plates 26 interconnected by cross braces 28 and having a skid 30 formed along the lower edge 32 of each side plate.

Figure 3:
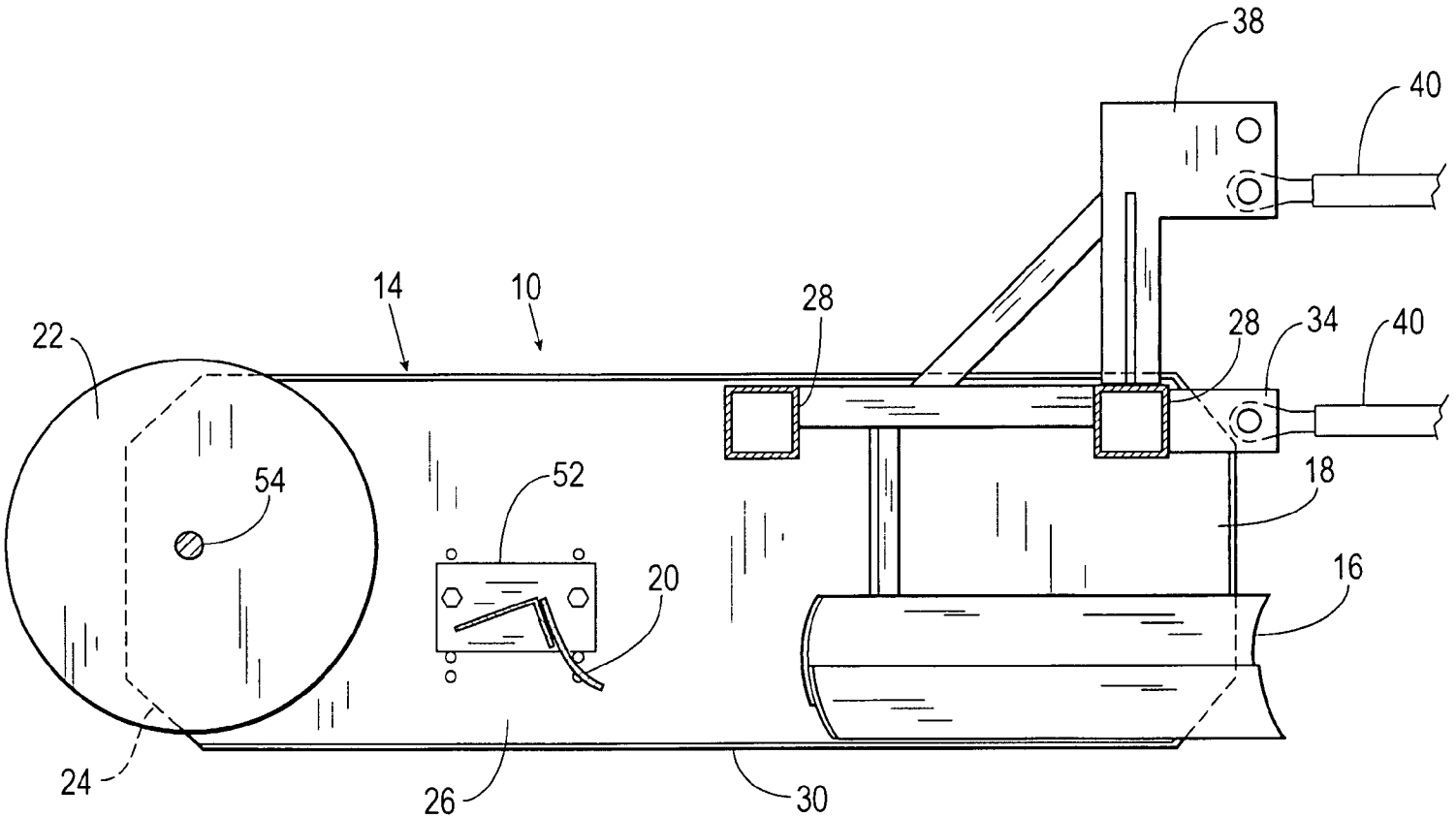
FIG. 3 is a longitudinal cross sectional view through the device.
Figure 4:
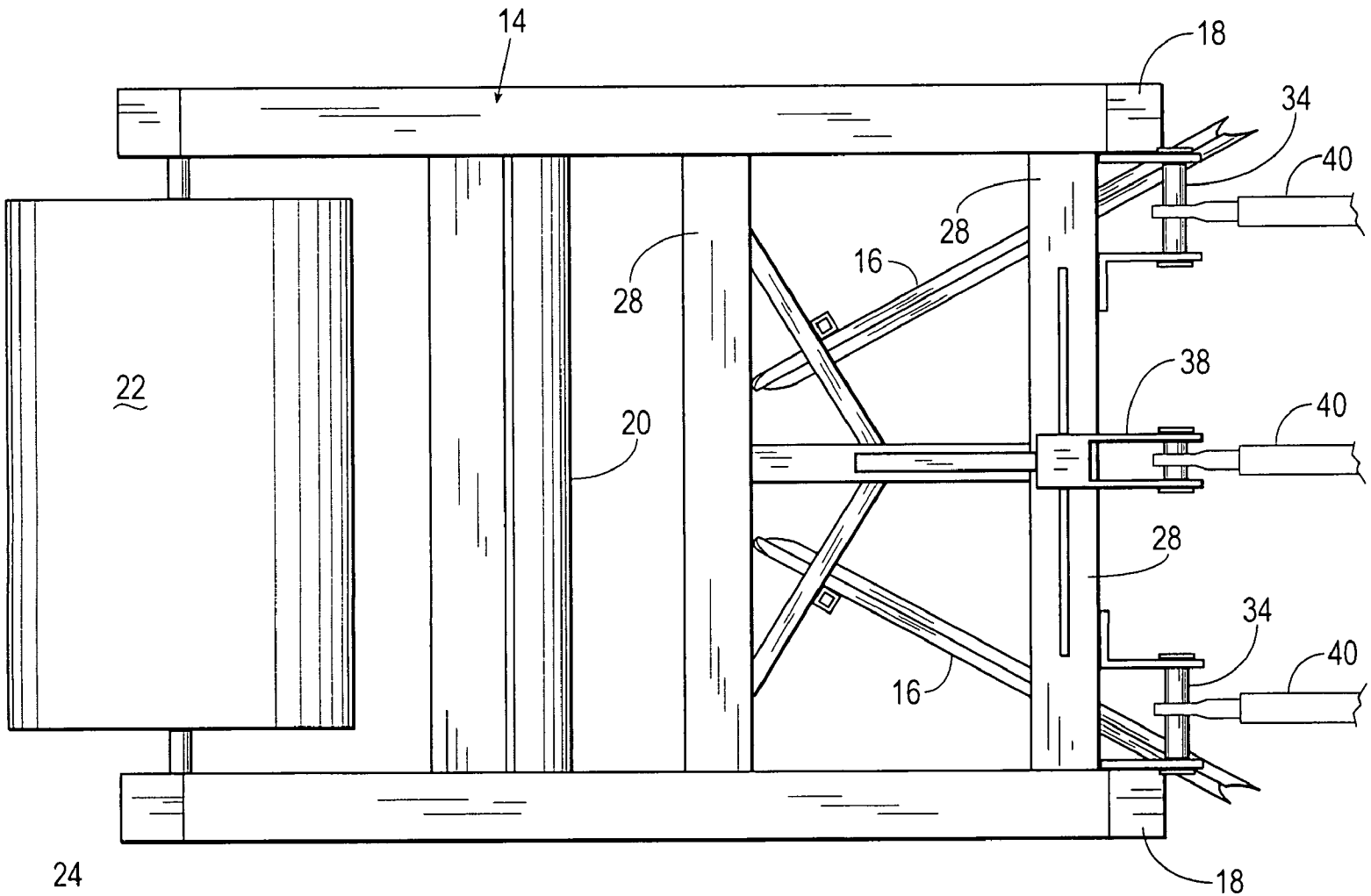
FIG. 4 is a plan view of the device.

As shown in FIGS. 3 and 4, a pair of brackets 34 are secured to the forward end 18 of the frame 14 near each side of the frame, and an upper bracket 38 is provided in the center of the frame for connection with the three point hitch 40 of the tractor 12. The device 10 can thus be towed as well as raised to an inoperative position by the use of the three point hitch 40 of the tractor 12.

Figure 5:
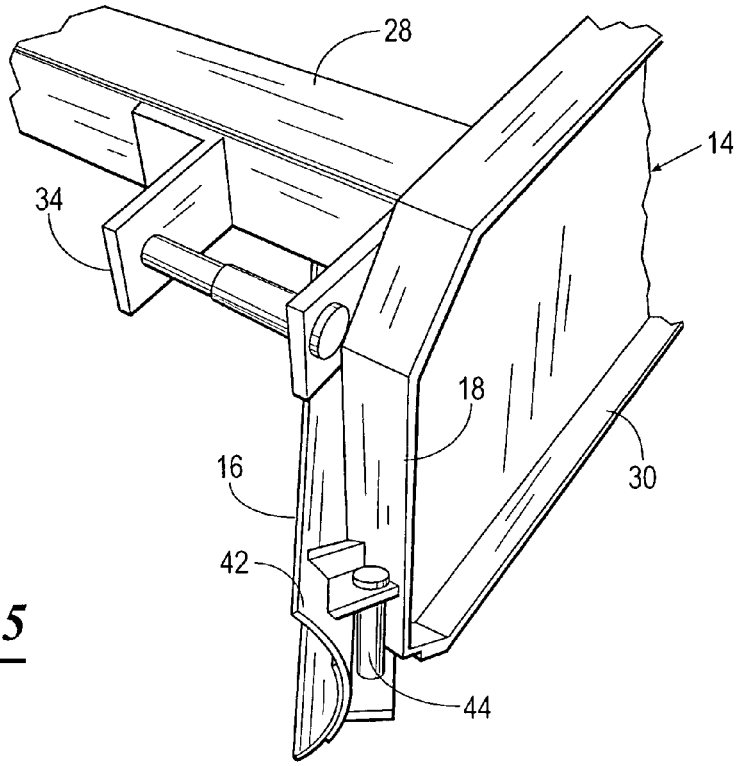
FIG. 5 is perspective view of the front left corner of the device.
Figure 6:
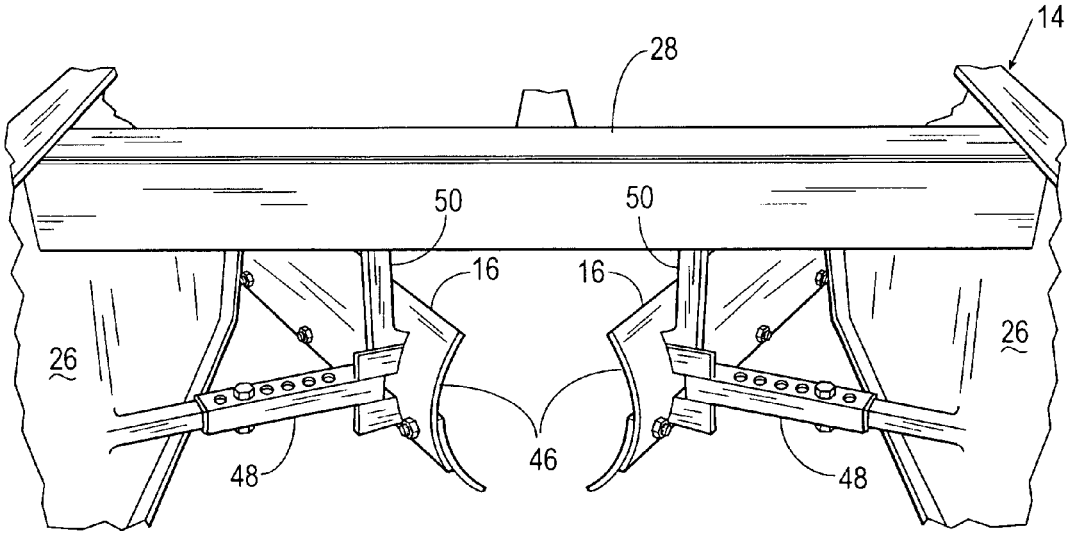
FIG. 6 is a front, perspective view of a portion of the device.

The forward end 42 of each of the rearwardly converging scraper blades 16 is suitably secured to the forward end 18 of the respective side of the frame 14 by a suitable bracket 44 as shown in FIG. 5. The rearward end 46 of each rearwardly converging scrape blade 16 is supported horizontally by a suitable adjustable bracket 48, by means of which the spacing between the rear end portions 46 of the scraper blades 16 may be adjusted as desired. The rear end portion 46 of each scrape blade 16 is secured vertically by a suitable bracket 50.

As indicated in FIG. 3, each end of the horizontally extending blade 20 is secured to the respective frame side plate 26 by an adjustable bracket 52 in order that the overall height of the blade 20 may be adjusted as desired by the local conditions. Normally, the blade 20 is positioned about three inches above the level of the skids 30.

As shown in FIG. 1, the roller 22 is mounted on a shaft 54. Each end of the shaft 54 is supported in a bearing 56 suitably secured to the respective side plate 26 by bolts 58. As indicated in FIG. 2, two sets of bolt holes 60 are provided in the frame side walls 26 to receive bolts 58 and provide for a vertical adjustment of the height of roller 22. Normally, the roller 22 is adjusted at a height a short distance above the skids 30, such as about one and one quarter inches.

Figure 7:
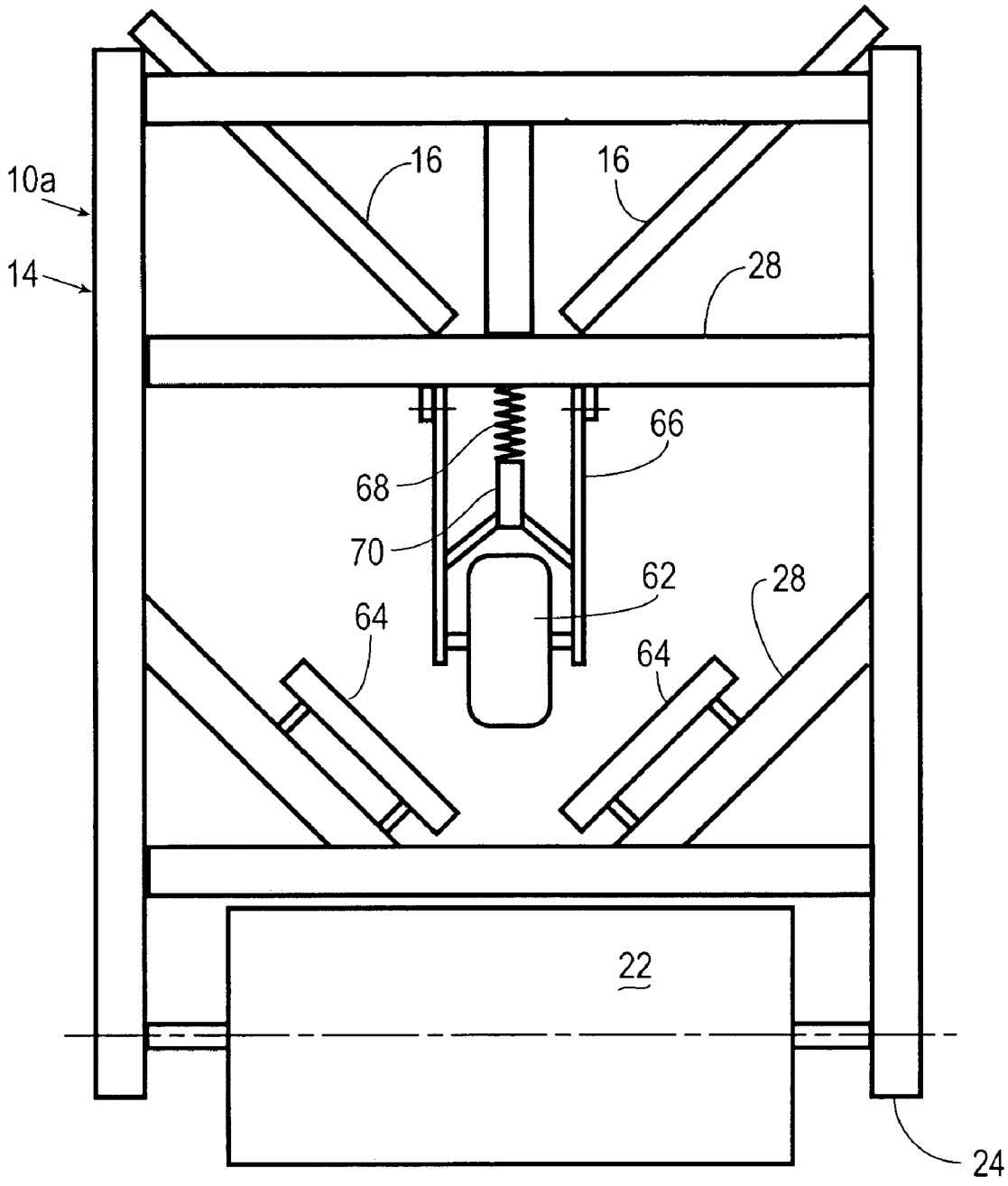
FIG. 7 is a schematic, plan view of an alternate embodiment.

An alternate embodiment 10*a* is shown schematically in FIG. 7. This alternate embodiment utilizes a virtually identical frame 14, as well as the rearwardly converging scraper blades 16 at the forward end of the device, and the roller 22 at the rear end of the device. Rather than the use of a scraper blade extending horizontally across the frame 14, the alternate embodiment 10*a* utilizes a rubber tire 62 for temporarily compressing the dirt moved into the trench by the blades 16, and a second pair of scraper blades 64 between the rubber tire 62 and the roller 22 to move dirt into the path of the central portion of the roller 22 which is disturbed by the rubber tire 62. The rubber tire is suitably supported by a linkage 66 from one of the cross frame members 28 utilizing a compression spring 68 and an adjustable jack mechanism or hydraulic cylinder 70, by means of which the rubber tire 62 will be urged downwardly against dirt moved by the scraper blades 16, and the amount of the compression provided by the spring 68 may be adjusted by the jack or cylinder 70 to provide the desired force on the dirt moved over the trench by the scraper blades 16. The secondary scraper blades 64 will be suitably mounted on cross braces 28 in such a manner that the angle of these blades may also be adjusted.

It will be understood by those skilled in the art that the blades 16 and 64 in FIG. 7 may be mounted in the frame 14 using hydraulic cylinders, rather than mechanically, for the convenience of the operator of the device.

OPERATION

Figure 3A:
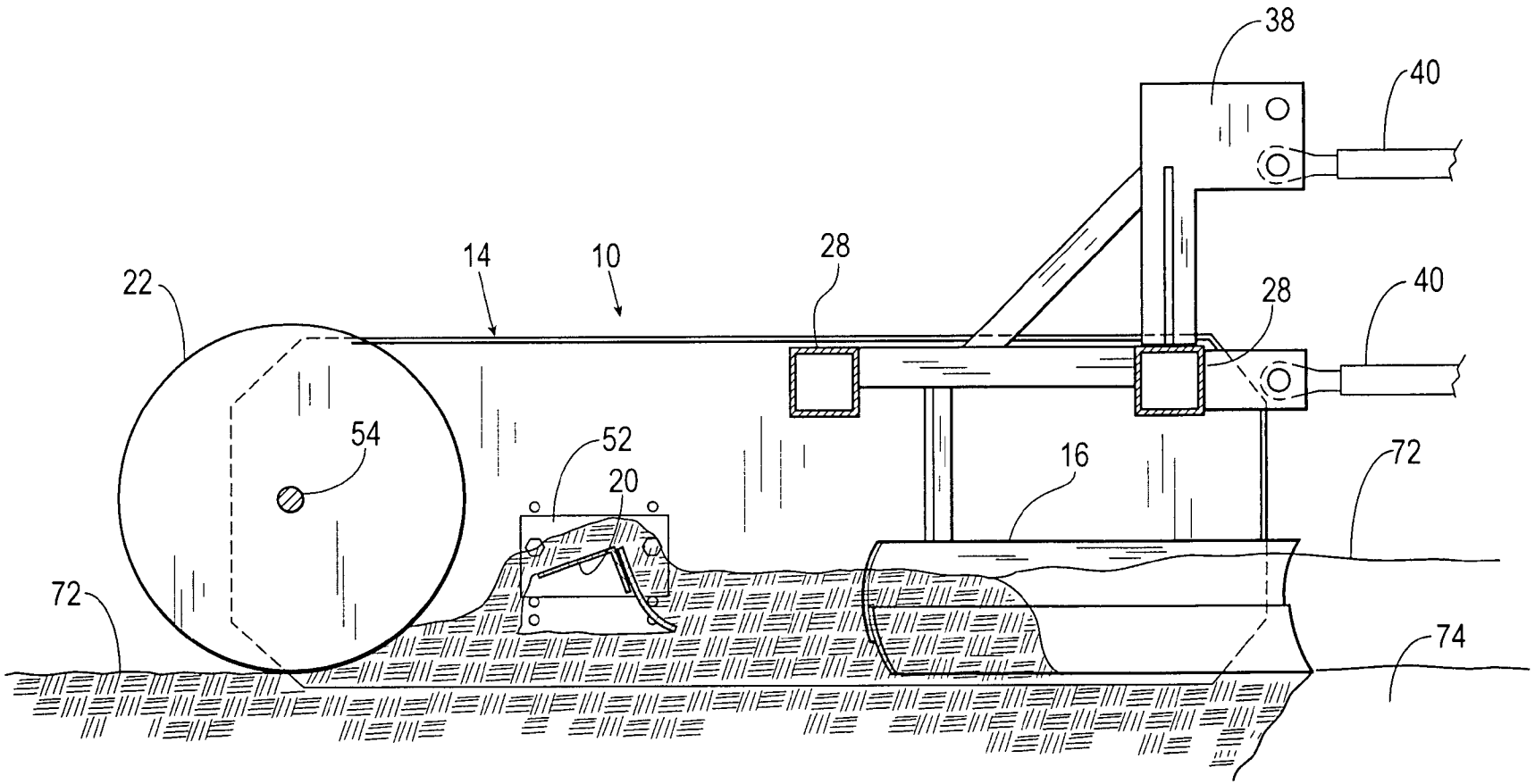
FIG. 3*a* is the same view as FIG. 3, but illustrating the location of the dirt being put back into the trench.

The purpose of device 10 is to move the dirt 72 (FIG. 3*a*) at each side of an open trench 74 into the trench and provide some compaction of the dirt moved back into the trench. As indicated in FIG. 3*a*, the scraper blades 16 move the dirt 72 into and over the trench 74 as the device 10 is pulled forwardly with the skids 30 straddling the trench.

The dirt moved by the scraper blades 16 will extend above the level of the ground on each side of the trench and the horizontally extending scraper blade 20 will temporarily level that dirt, before it is contacted and somewhat compressed or compacted by the roller 22. The level of the dirt behind the device 10 will be a short distance above the ground on each side of the trench, allowing for the dirt to settle in the trench and eventually end up with a relatively level surface where the trench had been.

The modified device 10A shown in FIG. 7 will provide a first compaction and spreading of the dirt first moved by the scraper blades 16 by operation of the rubber tires 62, and the dirt disturbed by the rubber tire 62 will be moved back over the center portion of the trench by the small scraper blades 64. Then the roller 22 will further compact the dirt and leave a surface slightly above the surrounding ground in the same manner as the device shown in the preferred embodiment.

Changes may be made in the combination and arrangement of parts or elements as here to fore set forth in the specification and shown in the drawing without departing from the spirit and scope of the invention as defined in the following claims.

What is claimed is:

1. A device for filling an open trench with dirt previously removed from the trench lying alongside the trench, comprising:

a frame having a forward end and a rear end, the frame sized to span the open trench and the dirt lying alongside thereof, the frame having a vertical side plate at each side thereof and a skid along the lower edge of each side plate for facilitating movement of the device along the open trench;

a pair of rearwardly converging blades supported by the frame for engaging and moving the previously removed dirt generally into and over the trench, the pair of rearwardly converging blades adjustably supported on the frame on either side of an axis that extends from the forward end of the frame to the rear of the frame such that the spacing between rear end portions of the rearwardly converging blades is adjustable inwardly and outwardly relative the axis; and a compaction roller rotatably supported in the rear end of the frame for compacting dirt moved into and over the trench.

2. The device of claim 1 wherein the frame includes brackets for attaching the forward end of the frame to a towing vehicle.

3. A device for filling an open trench with dirt previously removed from the trench lying alongside the trench, comprising:

a frame having a forward end and a rear end, the frame sized to span the open trench and the dirt lying alongside thereof, the frame having a vertical side plate at each side thereof and a skid along the lower edge of each side plate for facilitating movement of the device along the open trench;

a pair of rearwardly converging blades supported by the frame for engaging and moving the previously removed dirt generally into and over the trench, the pair of rearwardly converging blades adjustably supported on the frame on either side of an axis that extends from the forward end of the frame to the rear of the frame such that the spacing between rear end portions of the rearwardly converging blades is adjustable inwardly and outwardly relative the axis; and a wheel rotatably supported in the frame for compressing the dirt generally moved into and over the trench by the pair of rearwardly converging blades.

4. The device of claim 3 wherein the frame includes brackets for attaching the forward end of the frame to a towing vehicle.

5. The device of claim 3 further includes a compression spring connecting the wheel to the frame for urging the wheel toward the trench.

6. The device of claim 3 further comprising:

a second pair of rearwardly converging blades supported by the frame rearwardly of the wheel to move dirt that was forced out of the trench by the wheel back into the trench.

7. The device of claim 6, wherein the second pair of rearwardly converging blades is adjustably supported on the frame on either side of an axis that extends from the forward end of the frame to the rear of the frame such that the spacing between rear end portions of the second pair of rearwardly converging blades is adjustable inwardly and outwardly relative the axis.

* * * * *